US006074181A

United States Patent [19]

James

[11] Patent Number: 6,074,181

[45] Date of Patent: Jun. 13, 2000

[54] SHROUD FOR FAN MOTOR COOLING

[75] Inventor: Robert Wilton James, Crafers, Australia

[73] Assignee: FF Seeley Nominees Pty. Ltd., Australia

[21] Appl. No.: 09/113,038

[22] Filed: Jul. 9, 1998

[30] Foreign Application Priority Data

Jul. 9, 1998 [AU] Australia ..... PO7787

[51] Int. Cl.[7] ..... F04B 17/03

[52] U.S. Cl. ..... 417/366; 417/53; 417/369; 417/368

[58] Field of Search ..... 417/366, 368, 417/369, 362, 53

[56] References Cited

U.S. PATENT DOCUMENTS

| | | | |
|---|---|---|---|
| 1,669,459 | 5/1928 | Feinberg et al. | 417/366 |
| 2,388,998 | 11/1945 | Puffer et al. | 417/369 |
| 4,470,753 | 9/1984 | Witzel | 415/116 |

FOREIGN PATENT DOCUMENTS

| | | |
|---|---|---|
| 8543963 | 1/1986 | Australia . |
| 8944677 | 5/1990 | Australia . |
| 55665 | 7/1982 | European Pat. Off. . |
| 521285 | 1/1993 | European Pat. Off. . |
| 780579 | 6/1997 | European Pat. Off. . |
| 2410155 | 7/1979 | France . |
| 3127518 | 1/1983 | Germany . |
| 277720 | 4/1990 | Germany . |
| 4220669 | 7/1993 | Germany . |
| 19606146 | 8/1997 | Germany . |
| 09088895 | 3/1997 | Japan . |
| 10026098 | 1/1998 | Japan . |
| 1562537 | 6/1978 | United Kingdom . |
| 2060069 | 4/1981 | United Kingdom . |
| 2067665 | 6/1981 | United Kingdom . |
| 2117982 | 7/1983 | United Kingdom . |

*Primary Examiner*—Charles G. Freay
*Assistant Examiner*—Robert Z. Evora
*Attorney, Agent, or Firm*—Watts, Hoffman, Fisher & Heinke Co., L.P.A.

[57] ABSTRACT

Cooling means for cooling an electric motor mounted on or adjacent a volute of a centrifugal fan, the cooling means including an opening through the wall of the volute, and a shroud connected to the volute, the shroud including a volute end and a motor end, wherein the volute end of the shroud substantially covers the opening, and the motor end of the shroud extends around at least a portion of the periphery of the electric motor, such that the shroud provides a passage for flow of air from the volute and directs the flow of air around at least a portion of the periphery of the motor.

8 Claims, 2 Drawing Sheets

SHROUD FOR FAN MOTOR COOLING

FIELD OF INVENTION

This invention relates to motor cooling of a motor which drives a centrifugal type fan.

It is common practice for centrifugal fans to be driven by motors mounted on their volutes, and because in some circumstances the motors are required to run at varying speeds, there is a tendency to overheat particularly if the speeds are low, because of the inefficiency of the motor. It is difficult to retain the same efficiency in a motor over a wide range of speeds.

DESCRIPTION OF THE PRIOR ART

This problem has been well recognised, and heretofore motors have been cooled by intercepting some of the air displaced by the fan blades, and blowing that air over the motor. Australian Patent 642397 (44677189) illustrates and describes this arrangement. If the motor is not so cooled, the windings can increase in temperature, and that results in a corresponding increase in resistance so that there is a danger of windings getting so hot as to damage the insulation between the wires. However, the method previously employed used one or more tubes which entered the fan volute, and "scooped out" some of the air displaced by the fan blades, and this in turn disturbed the smooth air flow within the volute. Some twelve percent (12%) of air flow within the volute was lost due to that method of motor cooling, and it is the main object of this invention to provide an improvement whereby such losses are reduced.

It will be appreciated that air displaced by a fan within a fan volute is subject to radial acceleration, or viewed in another way, to centrifugal force. Use is made of this feature in the invention herein, wherein, the curved wall of a fan volute is provided with an opening, and the opening is associated with a shroud which directs air, displaced tangentially from its circular motion within the fan volute, around at least a portion of a motor to be discharged externally of the fan volute.

Without wishing to be limited by theory, it is believed that there is so little interference with the air flow within the volute that turbulence within the volute is reduced, such that any air flow loss within the volute appears to be in the order of two percent (2%), not the twelve percent (12%) reported with the previous arrangement described above Furthermore, because the air can be directed to circulate around the outside of the motor for most if not all of its peripheral surface, it is not necessary to use as much air as previously and, for example, instead of thirty liters per second being required, the quantity of air can be reduced to as little as fifteen liters per second. However, due to variation of static pressure within a fan volute, it may be necessary to select the location of the opening around the volute.

SUMMARY OF THE INVENTION

The present invention provides a cooling means for cooling an electric motor mounted on or adjacent a volute of a centrifugal fan, the cooling means including an opening through the wall of the volute, and a shroud connected to the volute, the shroud including a volute end and a motor end, wherein the volute end of shroud substantially covers the opening, and the motor end of the shroud extends around at least a portion of the periphery of the electric motor, such that the shroud provides a passage for flow of air from the volute and directs the flow of air around at least a portion of the periphery of the motor.

The invention will now be described with reference to and as illustrated in the accompanying drawings. However, it is to be appreciated that the following description is not to limit the generality of the above description.

DESCRIPTION OF THE PREFERRED EMBODIMENT

Figure 1:
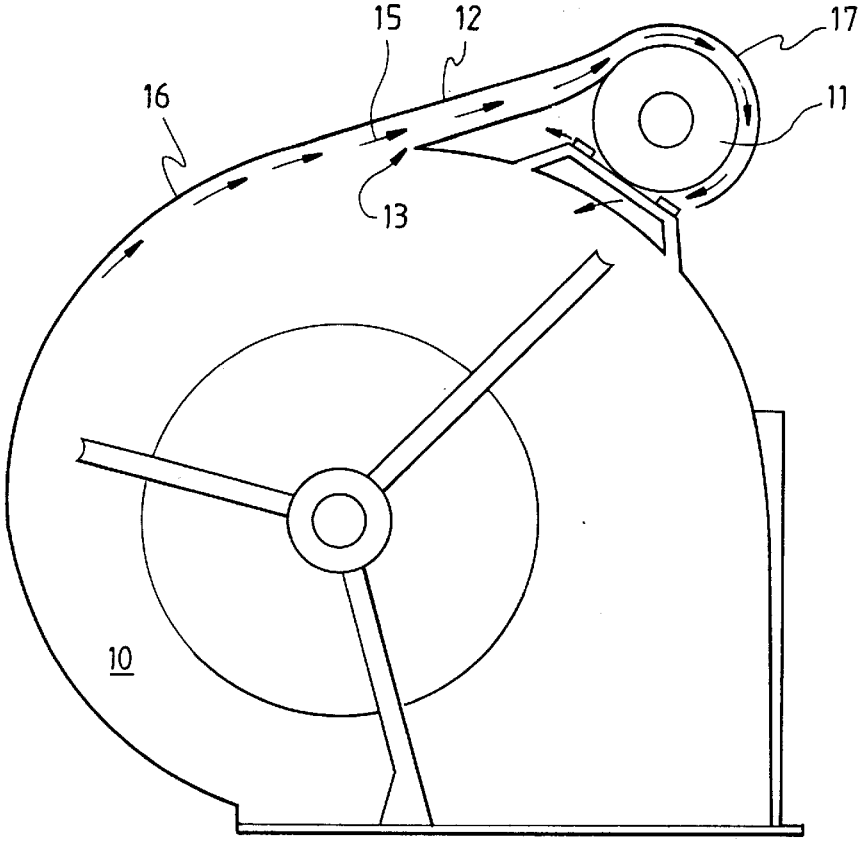
FIG. 1 diagrammatically shows a motor mounted on the outer curved surface of a fan volute, and shows the manner in which some air is taken from within the volute tangentially and is directed to the motor.

In this embodiment, a fan volute 10 contains an impeller (not shown) driven by a motor 11 which is mounted on the outside of the fan volute, and which requires cooling when in use. A shroud 12 is positioned over an opening 13 in the peripheral surface of the curved wall of the volute 10, the upper wall 14 of the shroud 12 overlying the opening 13 such that the upper wall is tangential to the curved wall of the volute 10 at that point. This allows the tangential exit of air flow 15 from within the curved wall 16 of the shroud 12. A part-cylindrical extension 17 of the shroud 12 at least partly surrounds motor 11, and the flow of air which is expelled through the opening 13 is constrained to move around at least a portion of the outer surface of the motor 11.

Figure 2:
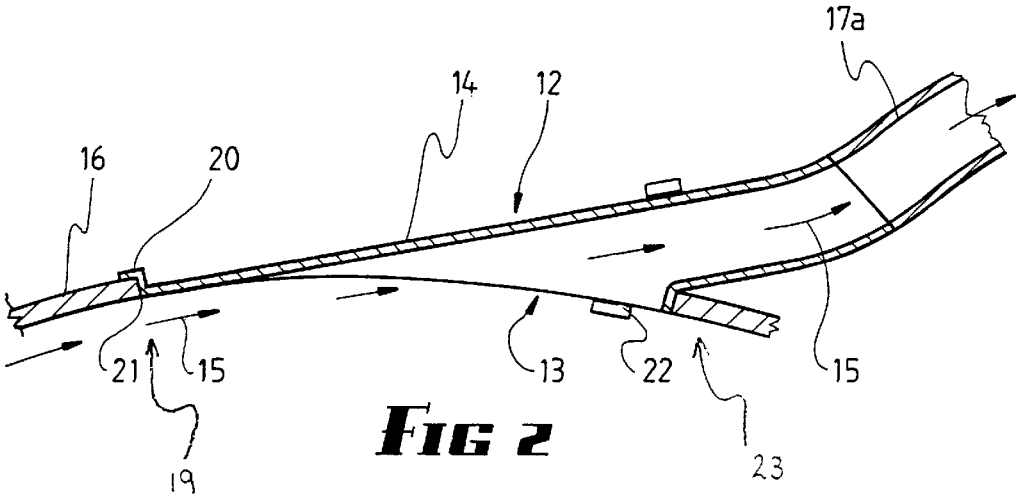
FIG. 2 is a section drawn to a larger scale than in FIG. 1 showing further details.
Figure 6:
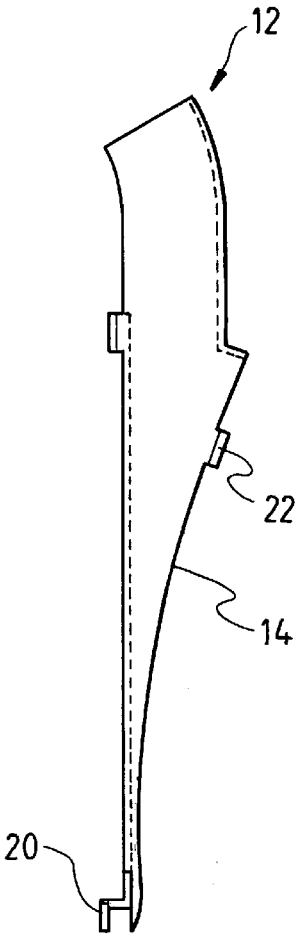
FIG. 6 is a side elevation of FIG. 5.
Figure 5:
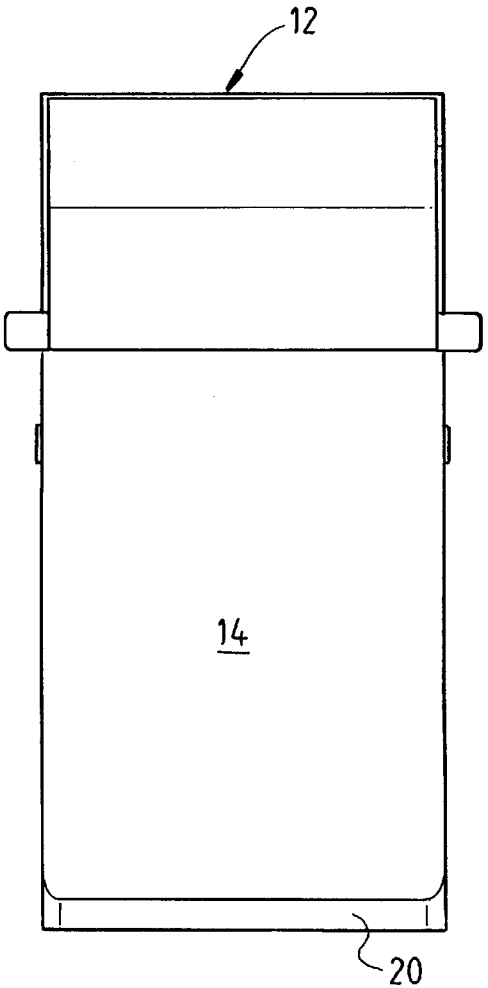
FIG. 5 is a top view of the shroud of FIG. 3.
Figure 4:
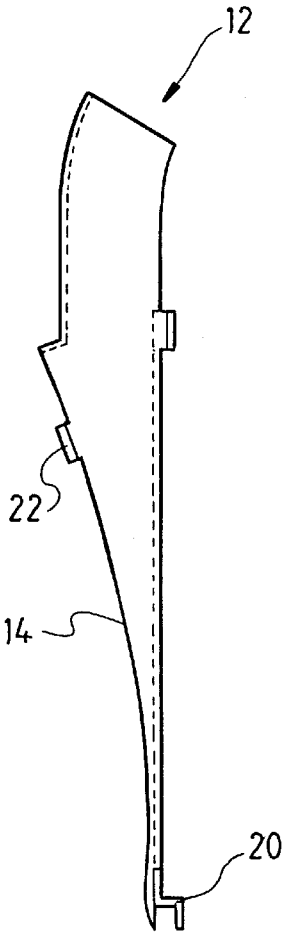
FIG. 4 is a side elevation of FIG. 3.
Figure 3:
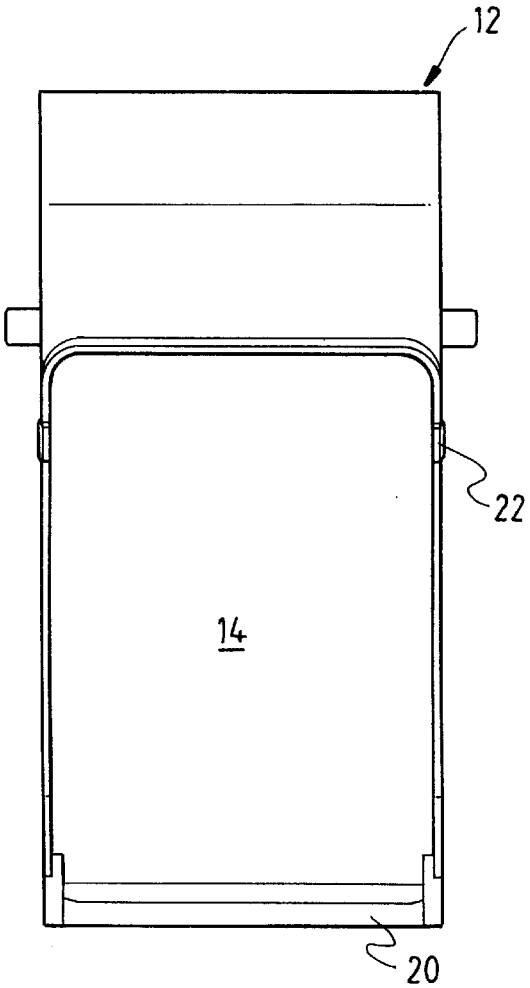
FIG. 3 is an underside view of a portion of a shroud which is attached to the fan volute as illustrated otherwise in FIG. 2.

The connection of the shroud 12 with the curved wall of the volute 10 is best illustrated in FIG. 2, the forward end 19 of the shroud 12 having a Z-shaped flange 20 which overlies the outer surface of the curved wall 16 at the location of the opening 13. Two fingers 21 engage the inner surface of wall 16 to firmly lock the forward end of the shroud 12 to the inner surface. Inwardly directed tabs 22 locate the rear end 23 of the shroud 12 with respect to the curved wall 16, while the interconnection between the shroud 12 and the part cylindrical extension 17 is effected by extension 17*a*.

The surprising effect of the shroud and the higher efficiency achieved results primarily from the redirection of air from the boundary layer of air flow within the curved wall of the volute, without appreciably changing its directional flow. Additionally, a contribution to the increased efficiency of the motor cooling is effected by the proximity of shroud 17 to most of the external surface of the motor 11. It will be clear to those skilled in the art that constructional details can be varied within this invention, but it has clear advantages over previously known systems which have been used for intercepting air for secondary uses, for example in vehicles or turbines.

What I/we claim is:

1. A cooling system for cooling an electric motor mounted near a wall of a volute of a centrifugal fan, the volute including:

an opening through a volute wall, a shroud connected to the volute, the shroud including, a volute end and a motor end, the volute end of the shroud covers an air flow communication passage of the volute opening, and the motor end of the shroud extending around at least a portion of a periphery of the electric motor, such that the shroud provides the passage for the flow of air from the volute and directs the flow of air around at least the portion of the periphery of the motor when the system is in use.

2. The cooling system according to claim 1, wherein the shroud extends from the volute end substantially tangential to an inside curved wall of the volute, whereby said flow of air is substantially drawn from a boundary layer of the air flow adjacent the curved wall of the volute.

3. The cooling system of claim 2, wherein a section of the shroud extending from the volute end toward the motor end is straight.

4. The cooling system of claim 1, wherein a section of the shroud extending from the volute end toward the motor end is straight.

5. A method of cooling an electric motor mounted near a volute of a centrifugal fan by a shroud located adjacent to an opening in the volute including the steps of:

removing a flow of air from a boundary layer of air flow adjacent to the inside of the the volute, directing the flow of air through the shroud to the motor: and, directing the flow of air through the shroud around at least a portion of the periphery of the motor.

6. The method according to claim 5, wherein the flow of air is directed in a substantially straight line from the volute to the motor.

7. In an evaporative cooler a fan construction comprising:

(A) a rotary impeller for inducing an air flow;

(B) a motor operatively connected to the impeller to rotate the impeller;

(C) a volute, having an impeller section disposed around the impeller, including an exit opening;

(D) a shroud with a conduit section having an inlet communicating with the exit opening of the volute and projecting from the impeller section in a direction of air flow toward the motor when fan construction is in use; and, (E) the shroud further including a motor housing section, partially surrounding the motor and communicating with a conduit section outlet, for directing a flow of air from the conduit section around the motor to cool the motor.

8. The construction of claim 7 wherein at least a portion of the motor housing section is concentric with a portion of an outer surface of the motor.

* * * * *